US005832425A

United States Patent [19]

Mead

[11] Patent Number: 5,832,425

[45] **Date of Patent: *Nov. 3, 1998**

[54] PHONEME RECOGNITION AND DIFFERENCE SIGNAL FOR SPEECH CODING/DECODING

[75] Inventor: Donald C. Mead, Carlsbad, Calif.

[73] Assignee: Hughes Electronics Corporation, El Segundo, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 827,678

[22] Filed: Apr. 10, 1997

Related U.S. Application Data

[63] Continuation-in-part of Ser. No. 318,011, Oct. 4, 1994, abandoned.

[51] Int. Cl.[6] ..... G10L 3/02

[52] U.S. Cl. ..... 704/221; 704/254

[58] Field of Search ..... 704/219–223, 704/243, 245, 255, 256, 254

[56] References Cited

U.S. PATENT DOCUMENTS

| | | | |
|---|---|---|---|
| 4,718,087 | 1/1988 | Rapamichalis | 381/34 |
| 4,799,261 | 1/1989 | Lin et al. | 381/36 |
| 4,802,223 | 1/1989 | Lin et al. | 381/38 |
| 5,027,404 | 6/1991 | Taguchi | 381/37 |
| 5,056,143 | 10/1991 | Taguchi | 381/35 |
| 5,432,884 | 7/1995 | Kapanen et al. | 395/2.37 |

FOREIGN PATENT DOCUMENTS

| | | | |
|---|---|---|---|
| 0 071 716 A2 | 2/1983 | European Pat. Off. | G10L 1/00 |
| 0 108 609 A1 | 5/1984 | European Pat. Off. | G10L 1/04 |
| 0 423 800 A2 | 4/1991 | European Pat. Off. | G01L 5/06 |
| 2-241399 | 10/1991 | Japan . | |
| 3-228433 | 10/1991 | Japan . | |

*Primary Examiner*—David D. Knepper
*Attorney, Agent, or Firm*—John A. Crook; Michael W. Sales

[57] ABSTRACT

An analog-to-digital converter (20) forms a digital signal based upon an analog speech signal. A phoneme parser (22) parses the digital signal into at least one phoneme. A phoneme recognizer (24) assigns a symbolic code to each phoneme based upon recognition of the phonemes from a predetermined set. A read-only memory (34) contains a standard waveform representation of each phoneme from the predetermined set. A difference processor (32) forms a difference signal between a user-spoken phoneme waveform and a corresponding waveform from the read-only memory (34). The difference signal is stored in a storage device (40). A multiplexer (30) provides a bit stream signal based upon the symbolic code and the difference signal. A synchronizer (70) extracts the symbolic code and the difference signal from the bit stream. A phoneme generator (76) forms the speech signal based upon the symbolic code and the difference signal.

33 Claims, 6 Drawing Sheets

PHONEME RECOGNITION AND DIFFERENCE SIGNAL FOR SPEECH CODING/DECODING

This is a continuation-in-part of application Ser. No. 08/318,011 filed Oct. 4, 1994, now abandoned.

TECHNICAL FIELD

The present invention relates generally to methods and systems for speech signal processing, and more particularly, to methods and systems for encoding and decoding speech signals.

BACKGROUND OF THE INVENTION

Speech compression systems are employed to reduce the number of bits needed to transmit and store a digitally-sampled speech signal. As a result, a lower bandwidth communication channel can be employed to transmit a compressed speech signal in comparison to an uncompressed speech signal. Similarly, a reduced capacity of a storage device, which can comprise a memory or a magnetic storage medium, is required for storing the compressed speech signal. A general speech compression system includes an encoder, which converts the speech signal into a compressed signal, and a decoder, which recreates the speech signal based upon the compressed signal.

In the design of the speech compression system, an objective is to reduce the number of bits needed to represent the speech signal while preserving its message content and intelligibility. Current methods and systems for speech compression have achieved a reasonable quality of message preservation at a transmission bit rate of 4.8 kilobits per second. These methods and systems are based upon directly compressing a waveform representation of the speech signal.

SUMMARY OF THE INVENTION

The need exists for a speech compression system which significantly reduces the number of bits needed to transmit and store a speech signal, and which simultaneously preserves the message content of the speech signal.

It is thus an object of the present invention to significantly reduce the bit rate needed to transmit a speech signal.

Another object of the present invention is to provide a speech encoder and corresponding speech decoder which allows a selectable personalization of an encoded speech signal.

A further object of the present invention is to provide a symbolic encoding and decoding of a speech signal.

In carrying out the above objects, the present invention provides a system for encoding a speech signal into a bit stream. A phoneme parser parses the speech signal into at least one phoneme. A phoneme recognizer, coupled to the phoneme parser, assigns a symbolic code to each of the at least one phoneme based upon recognition of the at least one phoneme from a predetermined phoneme set. A difference processor forms a difference signal between a user-spoken phoneme waveform and a corresponding waveform from a standard waveform set. The bit stream is based upon the difference signal and the symbolic code of each of the at least one phoneme.

Further in carrying out the above objects, the present invention provides a system for recreating a speech signal from a bit stream representative of an encoded speech signal. A synchronizer extracts at least one symbolic code from the bit stream, wherein each of the at least one symbolic code is representative of a corresponding phoneme from a predetermined phoneme set. The synchronizer further extracts at least one difference signal representative of a difference between a first phoneme waveform and a second phoneme waveform. A phoneme generator, which is coupled to the synchronizer, forms the speech signal by generating a corresponding phoneme waveform for each of the at least one symbolic code extracted by the synchronizer in dependence upon the at least one difference signal.

Still further in carrying out the above objects, the present invention provides a method of encoding a speech signal into a bit stream. The speech signal is parsed into at least one phoneme. The at least one phoneme is recognized from a predetermined phoneme set. A symbolic code is assigned to each of the at least one phoneme. A difference signal is formed between a user-spoken phoneme waveform and a corresponding phoneme waveform from a standard waveform set. The bit stream is formed based upon the difference signal and the symbolic code of each of the at least one phoneme.

Yet still further in carrying out the above objects, the present invention provides a method of recreating a speech signal from a bit stream representative of an encoded speech signal. At least one symbolic code is extracted from the bit stream, wherein each of the at least one symbolic code is representative of a corresponding phoneme from a predetermined phoneme set. At least one difference signal is extracted from the bit stream, wherein the at least one difference signal is representative of a difference between a first phoneme waveform and a second phoneme waveform. The recreated speech signal is formed by generating a corresponding phoneme waveform for each of the at least one symbolic code and combining it with the at least one difference signal.

These and other features, aspects, and advantages of the present invention will become better understood with regard to the following description, appended claims, and accompanying drawings.

DETAILED DESCRIPTION OF THE INVENTION

In overcoming the disadvantages of previous systems, the present invention provides an encoder/transmitter and a corresponding decoder/receiver which employ phoneme recognition and coding. Phonemes represent the basic unit of speech, i.e. the fundamental sounds, of which there are approximately forty in the English language. By determining the phonemes which were spoken by a user, symbolically coding the phonemes for transmission, and generating an appropriate phoneme waveform in response to receiving the coded phonemes, the original speech can be recreated. Further, the decoder can include an adaptive section which personalizes the synthesized voice based upon a personalization increment learned during a training mode of the encoder and transmitted to the decoder as a header at the beginning of a conversation.

Figure 1A:
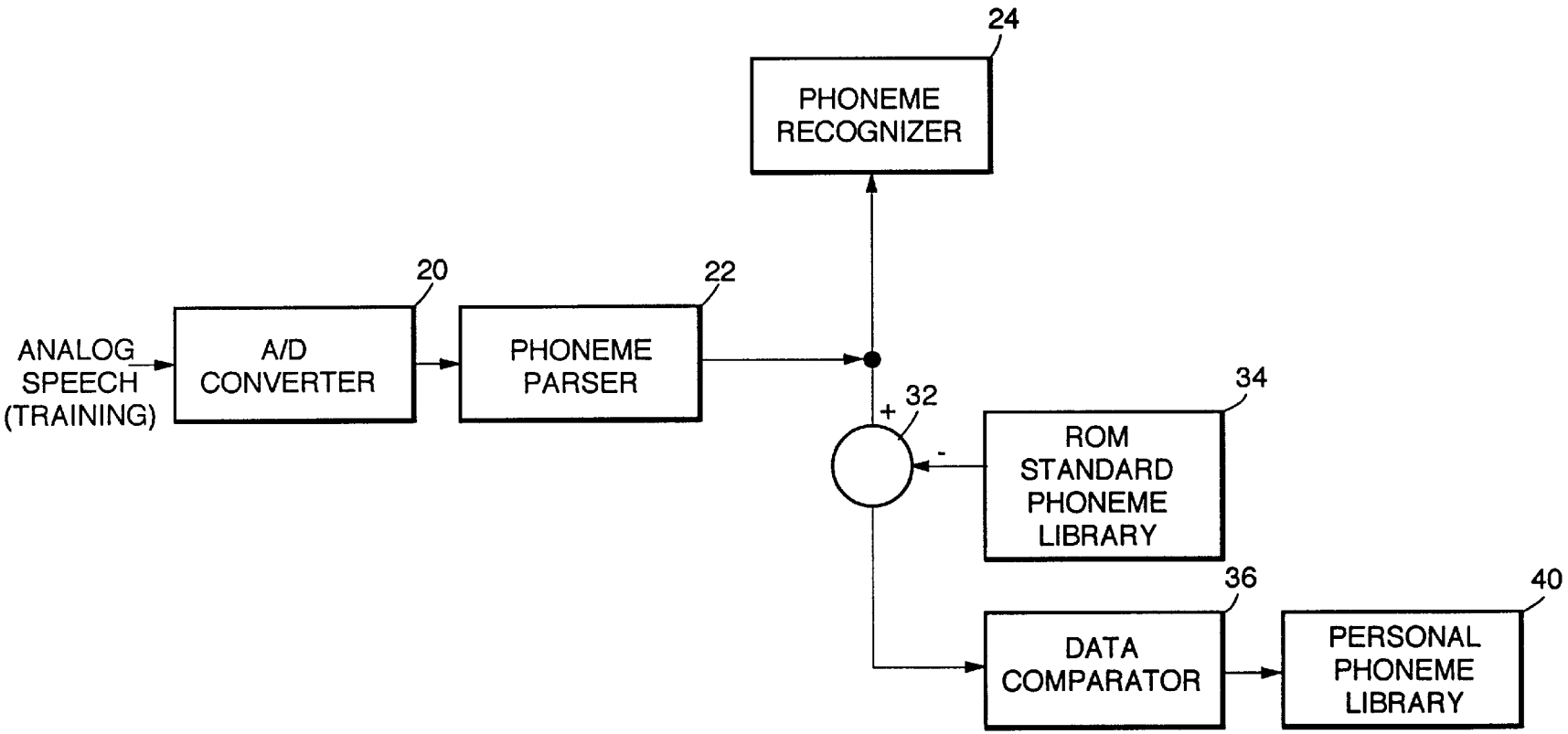
FIGS. 1A, 1B and 1C are block diagrams of an embodiment of an encoder shown in "training," "transmit initiate," and "transmit" modes, respectively, in accordance with the present invention.
Figure 1B:
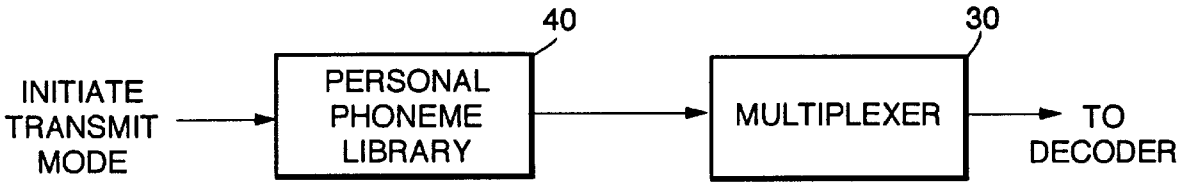
Figure 1C:
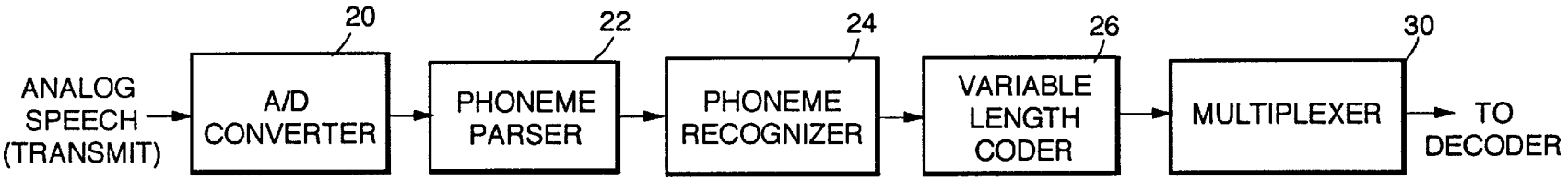

An embodiment of a speech encoder in accordance with the present invention is illustrated by the block diagrams in FIGS. 1A, 1B and 1C. FIG. 1A shows the block diagram for the speech encoder in "training" mode. FIG. 1B shows the block diagram of the encoder when it is being set up for "transmit" mode. FIG. 1C shows the block diagram of the speech encoder once "transmit" mode is entered. The speech encoder provides a system for encoding a speech signal into a bit stream signal for transmission to a corresponding decoder. In training mode (FIG. 1A), an analog speech signal is applied to an analog-to-digital converter 20. The analog-to-digital converter 20 digitizes the analog speech signal to form a digital speech signal. A phoneme parser 22 is coupled to the analog-to-digital converter 20. The phoneme parser 22 identifies the time base for each phoneme contained within the digital speech signal, and parses the digital speech signal into at least one phoneme based upon the time base.

The phoneme parser 22 is coupled to a phoneme recognizer 24 which recognizes the at least one phoneme from a predetermined phoneme set 34, and assigns a symbolic code to each of the at least one phoneme. In a preferred embodiment for the English language, the phoneme recognizer 24 assigns a unique six-bit symbolic code to each of the approximately forty phonemes in the English language. It is noted that the number of bits employed in coding each phoneme in the English language is not limited to six. For example, eight-bit codes, capable of representing 256 different phonemes, can also be employed. One with ordinary skill in the art will recognize that the number of bits needed for coding the phonemes is dependent upon the number of phonemes in the language of interest.

The phoneme parser 22 is coupled to difference processor 32 which forms a difference signal between a user-spoken phoneme waveform and a corresponding from a standard phoneme waveform library. The standard phoneme library 34 is contained within a first electronic storage device, such as a read-only memory, coupled to the difference processor 32. The first electronic storage device contains a standard waveform representation of each phoneme from the predetermined phoneme set 34.

The difference signal is compressed by a data compressor 3G coupled to the output of the difference processor 32. A representation of the compressed difference signal is stored in a second electronic storage device which contains the personal phoneme library 40. As a result, the second electronic storage device contains a personal phoneme library 40 or the user of the encoder.

Moving on to FIG. 1B, to initiate and set up transmit mode, multiplexer 30 is coupled to the second electronic storage device which contains the personal phoneme library 40. The bit stream provided by the multiplexer 30 is based upon both the symbolic code generated by the phoneme recognizer 24 and the representation of the difference signal from the personal phoneme library 40. The multiplexer 30 formats a header based upon the personal phoneme library 40 upon the initiation of transmission. After transmitting any synchronization or initiation bits, if necessary, the header is transmitted followed by the coded serial speech bit stream (in transmit mode).

FIG. 1C shows the encoder in "transmit" mode. Similar to the operation in training mode, the analog speech signal is applied to analog-to-digital converter 20 to form a digital speech signal. Phoneme parser 22 parses the digital speech signal into at least one phoneme which is applied to phoneme recognizer 24. The symbolic code from the phoneme recognizer 24 is applied to a variable length coder 26. The variable length coder 26 provides a variable length code of the symbolic code based upon the relative likelihood of the corresponding phoneme to be spoken. More specifically, phonemes which occur frequently in typical speech are coded with shorter length codes, while phonemes which occur infrequently are coded with longer length codes. The variable length coder 26 is employed to reduce the average number of bits needed to represent a typical speech signal. In a preferred embodiment, the variable length coder employs a Huffman coding scheme. The variable length coder 26 is coupled to a multiplexer 30 which formats the variable length code into a serial bit stream for transmission to a decoder.

Figure 2A:
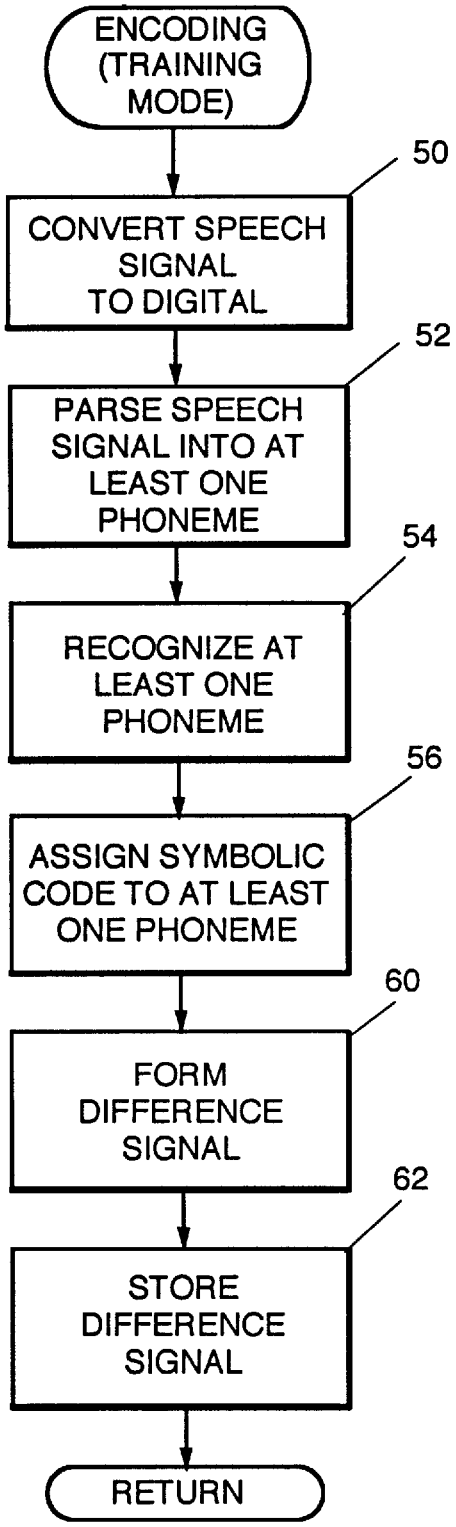
FIGS. 2A, 2B and 2C are flow charts of a method of encoding a speech signal shown in "training," "transmit initiate," and "transmit" modes, respectively.
Figure 2B:
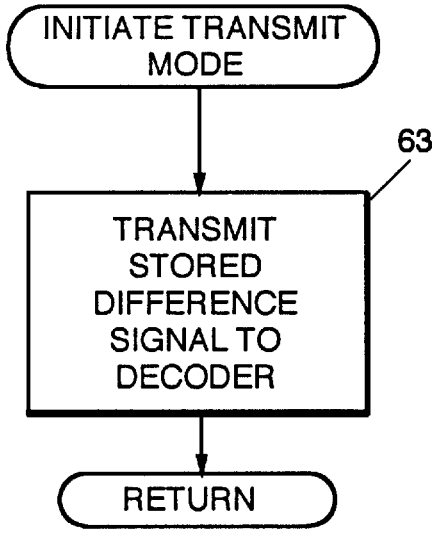
Figure 2C:
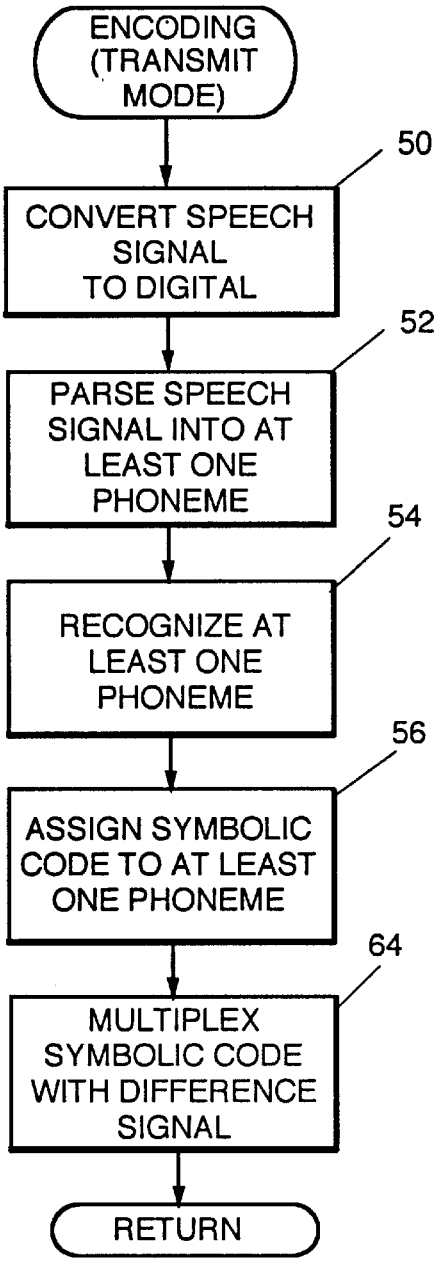

In accordance with the present invention, an embodiment of a method of encoding a speech signal into a bit stream signal is illustrated by the flow charts in FIGS. 2A, 2B and 2C. In FIGS. 2A and 2C, with the encoder in "training" or "transmit" mode, if the speech signal is an analog speech signal, then a step of converting the analog speech signal into a digital speech signal is performed in block 50. A step of parsing the digital speech signal into at least one phoneme is performed in block 52. In block 54, a step of recognizing the at least one phoneme is performed. Block 56 performs a step of assigning a symbolic code to each of the at least one phoneme. Blocks 60 and 62, which are only performed in training mode, perform the steps of forming a difference signal between a user-spoken phoneme waveform and a corresponding phoneme waveform from a standard phoneme waveform set, and storing a representation of the difference signal. FIG. 2B shows the method employed to initiate "transmit" mode. It includes only block 63, the step of transmitting the stored difference signal to the decoder. In block 64, which is performed only in "transmit" mode, a step of multiplexing the symbolic code with the representation of the difference signal to form the bit stream signal is performed.

Figure 3A:
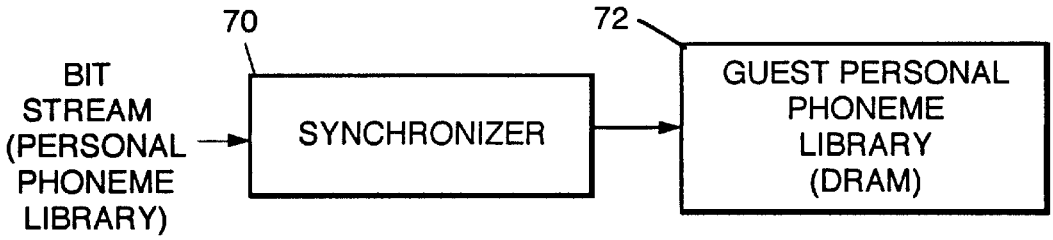
FIGS. 3A and 3B are block diagrams of an embodiment of a decoder in "receive initiate" and "receive" modes, respectively.
Figure 3B:
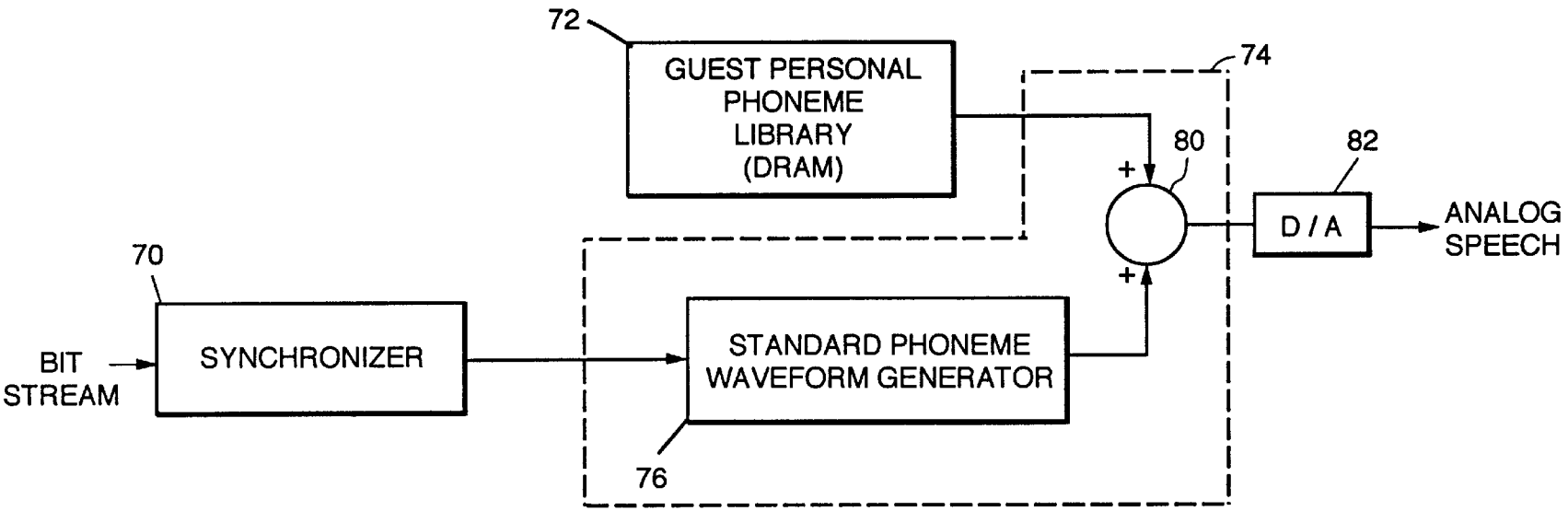

In accordance with the present invention, an embodiment of a decoder is illustrated by the block diagrams in FIGS. 3A and 3B. The decoder provides a system for recreating a speech signal from a bit stream, representative of an encoded speech signal, received from a corresponding encoder. In FIG. 3A, the bit stream enters a synchronizer 70, which generates an internal clock signal in order to lock onto the bit stream. The synchronizer 70 extracts at least one difference signal representative of a difference between a user-spoken phoneme waveform and a corresponding phoneme waveform from a standard phoneme waveform set. In a preferred embodiment, the at least one difference signal is received within a header in the bit stream. In "receive initiate" mode shown in FIG. 3A, the synchronizer 70 is coupled to a decoder 78 which decompresses the at least one difference signal, and the decoder is coupled to a storage device 72 which stores a representation of the at least one difference signal. In a preferred embodiment, the synchronizer sends the header to the storage device 72. As a result, the storage device 72, which can be embodied by a standard DRAM (dynamic random access memory), forms a guest personal phoneme library for the decoder.

Once the personalization has been received to set up "receive" mode, FIG. 3B shows the operation of the decoder in "receive" mode. The synchronizer 70 further extracts at least one symbolic code from the bit stream, wherein each of the at least one symbolic code is representative of a corresponding phoneme from a predetermined phoneme set. In a preferred embodiment, the synchronizer 70 blocks the bit stream into variable length blocks, each representing a phoneme. The at least one symbolic code is applied to a phoneme generator 74, which is coupled to the synchronizer 70. The phoneme generator 74 includes a standard phoneme waveform generator 76 which generates a corresponding phoneme waveform from the standard waveform set for each of the at least one symbolic code. The phoneme generator 74 can further include a look-up table which converts the variable length blocks to fixed length blocks to address the phoneme waveform generator 76. In a preferred embodiment, each of the blocks selects a particular phoneme from the standard waveform set. As a result, a recreated speech signal, typically represented digitally, is formed.

The phoneme generator 74 is further coupled to the storage device 72. The storage device 72 provides the at least one difference signal to the phoneme generator so that the recreated speech signal can be modified in dependence thereupon. More specifically, the phoneme generator 74 includes a summing element 80 which combines the phoneme waveform from the standard waveform set with the difference signal in order to recreate the voice of the original speaker. The output of the phoneme generator 74 is applied to a digital-to-analog converter 82 in order to form an analog recreated speech signal.

Figure 4A:
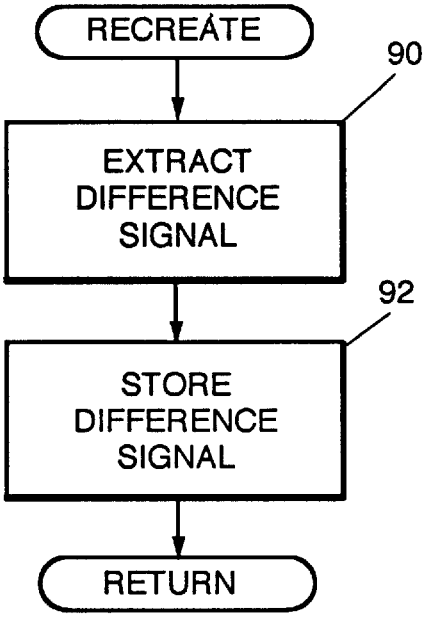
FIGS. 4A and 4B are flow charts of a method of decoding a speech signal, shown in "receive initiate" and "receive" modes, respectively.
Figure 4B:
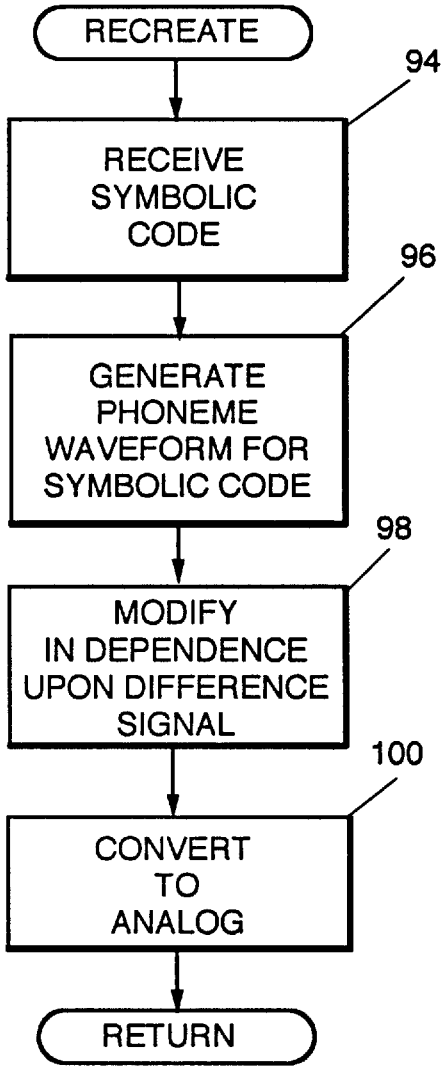

In accordance with the present invention, an embodiment of a method of recreating a speech signal from a bit stream representative of an encoded speech signal is illustrated by the flow charts in FIGS. 4A and 4B. In FIG. 4A, during the "receive initiate" mode, a step of extracting at least one difference signal representative of a difference between a user-spoken phoneme waveform and a corresponding phoneme waveform from a standard phoneme waveform set is performed in block 90. Block 92 performs a step of storing a representation of the at least one difference signal. FIG. 4B shows the method of recreating a speech signal in "receive" mode. In block 94, a step of extracting at least one symbolic code from the bit stream is performed, wherein each of the at least one symbolic code is representative of a corresponding phoneme from a predetermined phoneme set. A step of forming a digital recreated speech signal is performed in block 96. More specifically, a corresponding phoneme waveform from the standard phoneme waveform set is generated for each of the at least one symbolic code. Block 98 performs a step of modifying the digital recreated speech signal in dependence upon the at least one difference signal. In block 100, an optional step of converting the digital recreated speech signal into an analog recreated speech signal is performed.

The above-described embodiments of the present invention have many advantages. By recognizing and symbolically encoding phonemes, the required bit rate for transmitting a speech signal is significantly reduced. For example, if an average phoneme lasts about 100 milliseconds, the encoded speech signal using six bits per phoneme can be transmitted at a bit rate of 60 bits per second.

Another advantage of the present invention is the selectable personalization of the recreated speech which results from employing a personal phoneme library. Embodiments can include a default option which produces a purely synthetic voice in order to attain the lowest bit rate for operation. Similarly, a higher quality of speech can be produced in return for a higher bit rate of operation. As a result, the use of the personal phoneme library lends itself to adaptability. By determining the capacity of the decoder and a communication link which couples the encoder and decoder, the encoder can adapt to this capacity by sending out some of the personalization library in successive headers.

A further advantage of the present invention is that modern speech recognizers, which are capable of performing steps of phoneme parsing and statistical analysis of combinations of phonemes in forming words, can be employed in its implementation.

While the best mode for carrying out the invention has been described in detail, those familiar with the art to which this invention relates will recognize various alternative designs and embodiments for practicing the invention as defined by the following claims.

What is claimed is:

1. A system for encoding a speech signal into a bit stream, the system comprising:

a phoneme parser which parses the speech signal into at least one phoneme;

a phoneme recognizer, coupled to the phoneme parser, which assigns a symbolic code to each of the at least one phoneme based upon recognition of the at least one phoneme from a predetermined phoneme set; and a difference processor, coupled to the phoneme parser, which forms a difference signal between a user-spoken phoneme waveform and a corresponding phoneme waveform from a standard waveform set;

wherein the difference signal is stored during a "training" mode and transmitted in the bit stream during a "transmit initiate" mode.

2. The system of claim 1 further comprising a first storage device which contains a standard waveform representation of each phoneme from the predetermined phoneme set, the first storage device coupled to the difference processor to provide the corresponding phoneme waveform thereto.

3. The system of claim 2 wherein the first storage device includes a read-only memory.

4. The system of claim 2 further comprising a second storage device, coupled to the difference processor, in which a representation of the difference signal is stored.

5. The system of claim 4 further comprising a multiplexer, coupled to the phoneme recognizer and to the second storage device, which provides the bit stream based upon the symbolic code and the representation of the difference signal.

6. The system of claim 5 wherein the bit stream includes a header based upon the representation of the difference signal.

7. The system of claim 5 further comprising a variable length coder, interposed between the phoneme recognizer and the multiplexer, which provides a variable length code of the symbolic code for application the multiplexer.

8. The system of claim 1 wherein the speech signal is an analog speech signal.

9. The system of claim 8 further comprising an analog-to-digital converter which forms a digital speech signal based upon the analog speech signal, wherein the digital speech signal is applied to the phoneme parser.

10. A system for encoding an analog speech signal into a bit stream, the system comprising:

an analog-to-digital converter which forms a digital signal based upon the analog speech signal;

a phoneme parser which parses the digital signal into at least one phoneme;

a phoneme recognizer, coupled to the phoneme parser, which assigns a symbolic code to each of the at least one phoneme based upon recognition of the at least one phoneme from a predetermined phoneme set;

a first storage device which contains a standard waveform representation of each phoneme from the predetermined phoneme set;

a difference processor, coupled to the phoneme parser and to the first storage device, which during a "training" mode and during encoding forms a difference signal between a user-spoken phoneme waveform and a corresponding phoneme waveform from the first storage device;

a second storage device, coupled to the difference processor, in which a representation of the difference signal is stored for use in a header at the initiation of transmission; and a multiplexer, coupled to the phoneme recognizer and to the second storage device, which provides the bit stream based upon the symbolic code and the representation of the difference signal.

11. A method of encoding a speech signal into a bit stream, the method comprising the steps of:

parsing the speech signal into at least one phoneme;

recognizing the at least one phoneme from a predetermined phoneme set;

assigning a symbolic code to each of the at least one phoneme;

forming during a "training" mode and during encoding a difference signal between a user-spoken phoneme waveform and a corresponding phoneme waveform from a standard waveform set and stores the difference signal in a header for use at initiation of a transmission; and forming the bit stream based upon the difference signal and the symbolic code of each of the at least one phoneme.

12. The method of claim 11 further comprising the step of storing a standard waveform representation of each phoneme from the predetermined phoneme set.

13. The method of claim 11 further comprising the step of storing a representation of the difference signal.

14. The method of claim 13 wherein the step of forming the bit stream includes the step of multiplexing the symbolic code with the representation of the difference signal.

15. The method of claim 14 wherein the bit stream includes a header based upon the representation of the difference signal.

16. The method of claim 14 further comprising the step of variable length coding the symbolic code.

17. The method of claim 11 wherein the speech signal is an analog speech signal.

18. The method of claim 17 further comprising the step of converting the analog speech signal to a digital speech signal, wherein the digital speech signal is parsed into at least one phoneme.

19. A method of encoding an analog speech signal into a bit stream, the method comprising the steps of:

converting the analog speech signal into a digital signal;

parsing the digital signal into at least one phoneme;

recognizing the at least one phoneme from a predetermined phoneme set;

assigning a symbolic code to each of the at least one phoneme;

forming during a "training" mode and during encoding a difference signal between a user-spoken phoneme waveform and a corresponding phoneme waveform from a standard waveform set;

storing a representation of the difference signal;

transmitting the stored difference signal in a header: and multiplexing the symbolic code with the representation of the difference signal to form the bit stream.

20. A system for recreating a speech signal from a bit stream representative of an encoded speech signal, the system comprising:

a synchronizer which extracts at least one symbolic code from the bit stream, wherein each of the at least one symbolic code is representative of a corresponding phoneme from a predetermined phoneme set, the synchronizer further extracting at least one difference signal representative of a difference between a first phoneme waveform and a second phoneme waveform; and a phoneme generator, coupled to the synchronizer, which forms the speech signal by generating a corresponding phoneme waveform for each of the at least one symbolic code extracted by the synchronizer in dependence upon the at least one difference signal.

21. The system of claim 20 wherein the first phoneme waveform is based upon a user-spoken phoneme.

22. The system of claim 20 wherein the second phoneme waveform is a corresponding phoneme waveform from a standard waveform set.

23. The system of claim 20 further comprising a storage device, coupled to the synchronizer, which stores a representation of the at least one difference signal.

24. The system of claim 23 wherein the phoneme generator is coupled to the storage device, and wherein the phoneme generator forms the speech signal in dependence upon the at least one difference signal.

25. The system of claim 20 further comprising a digital-to-analog converter coupled to the phoneme generator, which forms an analog speech signal.

26. A system for recreating a speech signal from a bit stream representative of an encoded speech signal, the system comprising:

a synchronizer which extracts at least one symbolic code from the bit stream, wherein each of the at least one symbolic code is representative of a corresponding phoneme from a predetermined phoneme set, the synchronizer further extracting at least one difference signal representative of a difference between a user-spoken phoneme waveform and a corresponding phoneme waveform from a standard waveform set;

a storage device, coupled to the synchronizer, which stores a representation of the at least one difference signal;

a phoneme generator, coupled to the synchronizer and to the storage device, which forms a digital recreated speech signal by generating a corresponding phoneme waveform from the standard waveform set for each of the at least one symbolic code extracted by the synchronizer, wherein the digital recreated speech signal is modified in dependence upon the at least one difference signal; and a digital-to-analog converter, coupled to the phoneme generator, which forms an analog recreated speech signal from the digital recreated speech signal.

27. A method of recreating a speech signal from a bit stream representative of an encoded speech signal, the method comprising the steps of:

extracting at least one symbolic code from the bit stream, wherein each of the at least one symbolic code is representative of a corresponding phoneme from a predetermined phoneme set; and extracting at least one difference signal from the bit stream, wherein the at least one difference signal is representative of a difference between a first phoneme waveform and a second phoneme waveform; and forming the speech signal by generating a corresponding phoneme waveform for each of the at least one symbolic code in dependence upon the at least one difference signal.

28. The method of claim 27 wherein the first phoneme waveform is based upon a user-spoken phoneme.

29. The method of claim 27 wherein the second phoneme waveform is a phoneme waveform from a standard waveform set.

30. The method of claim 27 further comprising the step of storing a representation of the at least one difference signal.

31. The method of claim 30 further comprising the step of modifying the speech signal in dependence upon the at least one difference signal.

32. The method of claim 27 further comprising the step of converting the speech signal into an analog speech signal.

33. A method of recreating a speech signal from a bit stream representative of an encoded speech signal, the method comprising the steps of:

extracting at least one difference signal from the bit stream, wherein the at least one difference signal is representative of a difference between a user-spoken phoneme waveform and a corresponding phoneme waveform from a standard waveform set;

storing a representation of the at least one difference signal;

extracting at least one symbolic code from the bit stream, wherein each of the at least one symbolic code is representative of a corresponding phoneme from a predetermined phoneme set;

forming a digital speech signal by generating a corresponding phoneme waveform from the standard waveform set for each of the at least one symbolic code;

modifying the digital speech signal in dependence upon the at least one difference signal; and converting the digital speech signal to an analog speech signal.

* * * * *